US005090473A

United States Patent [19]

Makino et al.

[11] Patent Number: 5,090,473

[45] Date of Patent: Feb. 25, 1992

[54] CERAMIC ROTARY HEAT EXCHANGER

[75] Inventors: Mikio Makino, Kariya; Osamu Horikawa, Toyoake, both of Japan

[73] Assignee: NGK Insulators, Ltd., Japan

[21] Appl. No.: 614,395

[22] Filed: Nov. 16, 1990

[30] Foreign Application Priority Data

Nov. 28, 1989 [JP] Japan ..... 1-308158

[51] Int. Cl.[5] ..... F28D 19/04

[52] U.S. Cl. ..... 165/8; 165/10; 156/304.1

[58] Field of Search ..... 165/8, 10

[56] References Cited

U.S. PATENT DOCUMENTS 3,780,792 12/1973 Ritchie ..... 165/9

FOREIGN PATENT DOCUMENTS 2040680 8/1970 Fed. Rep. of Germany .

2938159 9/1979 Fed. Rep. of Germany .

*Primary Examiner*—Albert W. Davis, Jr.

*Attorney, Agent, or Firm*—Parkhurst, Wendel & Rossi

[57] ABSTRACT

A ceramic rotary heat exchanger including a plurality of matrix segments, made of ceramics and having a honeycomb structure, being connected with each other by using an adhesion member in a disk shape, and a plurality of pins arranged at an outer peripheral portion. In addition, the invention is a method of manufacturing the heat exchanger mentioned above, wherein the matrix segments are not positioned at connecting portions between respective matrix segments.

3 Claims, 3 Drawing Sheets

CERAMIC ROTARY HEAT EXCHANGER

BACKGROUND OF THE INVENTION

1. Field of the Invention

The present invention relates to a ceramic rotary heat exchanger used in high temperature gases in a field of a gas turbine rotor, a stirling engine, etc. and to a method of manufacturing the same.

2. Related Art Statement

The known ceramic rotary heat exchanger has a disk shape 20 to 200 cm in diameter and 2 to 20 cm in thickness, and has a honeycomb structure. A ceramic rotary heat exchanger having a diameter under 30 cm can be simultaneously formed by an extrusion method. However, it is not possible to form a ceramic rotary heat exchanger having a diameter more than 30 cm by a single extrusion Therefore, such a ceramic rotary heat exchanger is formed by extruding ceramic matrix segments having a honeycomb structure and bonding the matrix segments together by means of an adhesion member such as ceramic and glass etc., as shown in Japanese Patent Laid-Open Publication No. 55-46338 or Japanese Patent Laid-Open Publication No. 63-263394.

Moreover, the ceramic rotary heat exchanger mentioned above has a ring gear arranged on its outer portion and is rotated by means of a pinion geared with the ring gear. One known method of securing the ring gear to the outer portion of the ceramic rotary heat exchanger is to arrange solid pins in the outer portion of the ceramic rotary heat exchanger and to secure the ring gear by means of springs arranged between respective solid pins. The other known method is that the ring gear is secured to the outer portion of the ceramic rotary heat exchanger having no pins by binding forces of an elastic member arranged thereon.

In the ceramic rotary heat exchanger mentioned above, outer peripheral portions at both ends of the rotary heat exchanger are sealed, and a high temperature gas is passed through an inner portion thereof, an outer portion thereof being exposed to the air. Therefore, an abrupt temperature gradient occurs in the ceramic rotary heat exchanger and thus thermal stresses are generated in the seal portion (including the pin portion).

In order to improve thermal shock properties a method, such as that disclosed in Japanese Patent Laid-Open Publication No. 1-147291, is known which employs a foaming joint member for connecting the ceramic matrix segments. Further, the ceramic rotary heat exchanger using the pins for securing the ring gear is affected by a mechanical stress due to a driving force concentrated on the pin portion as compared with the heat exchanger using no pins.

In a case in which use is made of a matrix segment connecting technique such that through hole directions of each of the segments are positioned in one direction, as shown in Japanese Patent Laid-Open Publication No. 55-46338 or Japanese Patent Laid-Open Publication No. 62-263394, a position of the solid pins 3, each arranged at a constant distance, is likely to be located at a connecting portion between the segments, as shown in FIG. 3. In this case, since a pin 3 is arranged at the connection portion between the segments and a connecting distance near the pin portion utilizing the foaming joint member becomes long, a foaming force generated during a sintering process becomes larger at the connection portion mentioned above. Further, in this case, since the segment has a soft structure, the foaming force is adsorbed at the connection portion between the segments only. However, since the solid pin has a hard structure the foaming force is not absorbed at the connecting portion, including the pins between the segments. Therefore, in this case, a thickness of the connecting portion becomes thicker and a crack is generated. As a result, there occur drawbacks such that a mechanical strength of the connecting portion 2 is decreased and a heat exchanging efficiency becomes lower due to a decrease of heat conduction area, etc.

SUMMARY OF THE INVENTION

An object of the present invention is to eliminate the drawbacks mentioned above, and to provide a ceramic rotary heat exchanger having high mechanical strength, thermal shock strength, heat exchanging efficiency, etc, which can make a thickness of the connecting portion thinner even if the pin exists, and a method of manufacturing the ceramic rotary heat exchanger mentioned above.

According to the invention, a ceramic rotary heat exchanger comprises a plurality of matrix segments, made of ceramics and having a honeycomb structure, being connected with each other by using an adhesion member in a disk shape, and a plurality of pins arranged at an outer peripheral portion of the connected matrix segments, wherein the matrix segments are connected with each other in such a manner that the pins are not positioned at connecting portions between respective matrix segments.

Further, according to the invention, a method of manufacturing a ceramic rotary regenerator, having a plurality of pins arranged at an outer peripheral portion thereof, comprises the steps of preparing a plurality of matrix segments made of ceramics and having a honeycomb structure; connecting the matrix segments with each other by using a foaming adhesion member; embedding a plurality of pins at an outer peripheral portion of the connected matrix segments in such a manner that the pins are positioned more than 10 mm inside of edge portions of the matrix segments; sintering the connected matrix segments including the pins; and machining the sintered connected matrix segments into a disk shape together with the pins.

In the ceramic rotary heat exchanger according to the invention, as shown if FIG. 1, since the matrix segments 1 are connected with each other in such a manner that the pins 3 arranged at an outer peripheral portion of the heat exchanger are not positioned at the connecting portion 2 between the segments 3, the connecting portion 2 between the segments 3 does not become thick and a crack is not generated at the connecting portion 2.

Therefore, according to the invention, a thickness of the connecting portion 2 can be thinner, and a decrease in mechanical strength at the connecting portion 2 can be eliminated. Moreover, the thermal shock strength can not decrease. Further, an area for heat conduction can not decrease and a high heat exchanging efficiency can be maintained. The ceramic rotary heat exchanger according to the invention is secured inside of the ring gear by arranging a spring (not shown) to a recess portion 5 formed on an outer surface of respective pins 3, and is rotated by means of a pinion geared with the ring gear.

Moreover, according to the method of manufacturing the ceramic rotary regenerator, since sintering is performed for the heat exchanger in which the pin 3 is embedded in a position more than 10 mm inside of the edge of the matrix segment 1, a foaming force of the foaming joint member 4 generated during sintering is absorbed by the matrix segment 1 having the soft structure, and a part of the foaming force functions to make the connecting portion 2 of the matrix segment 1 thinner.

DESCRIPTION OF THE PREFERRED EMBODIMENTS

Hereinafter, the present invention will be explained with reference to the drawings.

Figure 1:
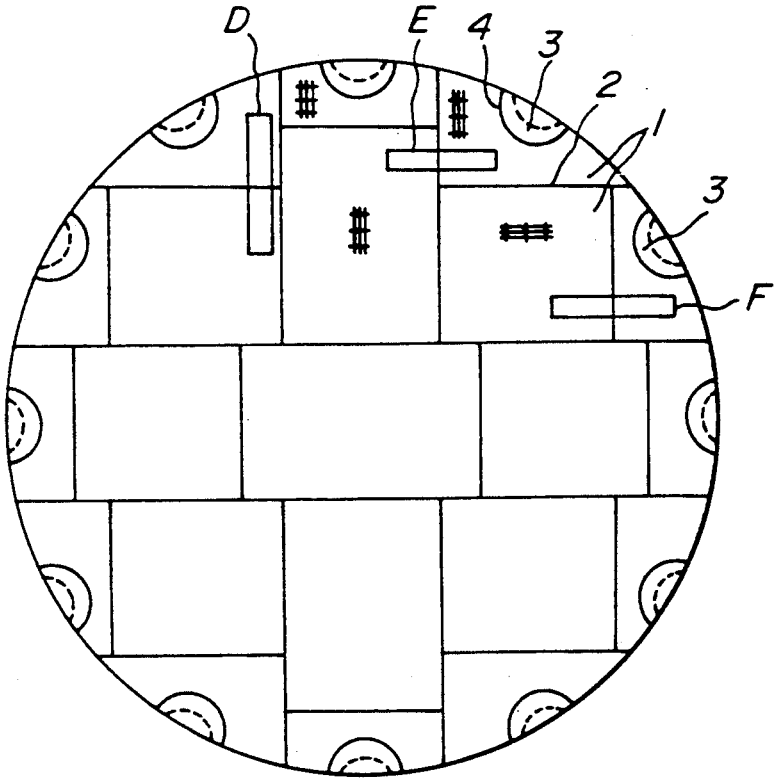
FIG. 1 is a plan view showing an embodiment of a ceramic rotary heat exchanger according to the invention.

FIG. 1 is a plan view showing an embodiment of a ceramic rotary heat exchanger according to the invention. In FIG. 1, a plurality of ceramic matrix segments 1 each having a honeycomb structure are connected with each other by using an adhesion member, and machined into a heat exchanger having a circular disk shape. A plurality of solid pins 3 are arranged at an outer peripheral portion of the heat exchanger with a constant distance therebetween. The matrix segments 1 are made of cordierite. A dimension of the honeycomb cell structure of the matrix segments 1 is a rectangular shape having short side pitch 0.56 mm, long side pitch: 0.96 mm, and a thickness of 0.11 mm. The matrix segments 1 having a specific cell structure are positioned as shown in the figure in such a manner that a direction to which Young's modulus becomes smallest is a circumferential direction.

All the pins 3 are arranged at positions at which no connecting portions 2 exist. However, since a position of the pins 3 on the peripheral portion of the heat exchanger is defined previously, it is necessary to choose a combination of the matrix segment arrangement so that the pins 3 are positioned more than 10 mm apart from the connecting portions 2.

Figure 2:
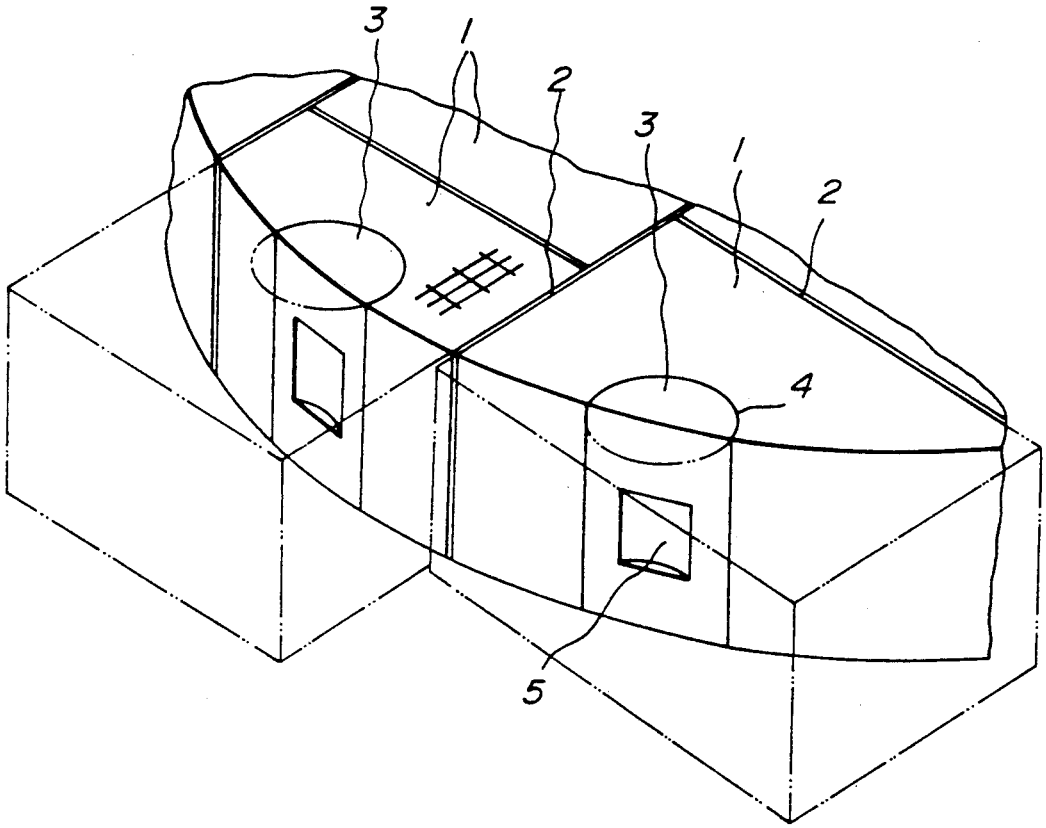
FIG. 2 is a perspective view for explaining manufacturing steps of the ceramic rotary heat exchanger according to the invention.

In order to obtain the ceramic rotary heat exchanger mentioned above, matrix segments 1 in which the cylindrical solid pins 3 are embedded in a position more than 10 mm inside from the edge thereof and matrix segments 1 in which no pins are embedded are prepared. The thus prepared matrix segments 1 are connected with each other as shown in FIG. 2 into a substantially disk shape. In this case, a foaming joint member 4 is arranged in a space between respective matrix segments 1 and in a space between the pin 3 and the matrix segment 1. The pin 3 is positioned at an outer peripheral portion which is machined and cut-out later. It should be noted that at this time the outer peripheral portion of the connected matrix segments 1 have an uneven shape as shown in FIG. 2 by a one dotted chain line.

The thus connected matrix segments are sintered to obtain an integral ceramic rotary regenerator. In this case, since the pins 3 are positioned more than 10 mm apart from the connecting portions 2 of respective matrix segments 1, a foaming force of the foaming joint member 4 during the sintering process can be absorbed by the matrix segment 1 having the soft structure. Therefore, the connecting portion between respective matrix portions 1 does not become thick and does not generate cracks. Thus, the matrix segments 1 are connected in a reliable manner. After that, the outer peripheral portion of the matrix segments 1 are machined mechanically into a circular shape as shown in FIG. 2 by a solid line together with the pin 3 to obtain the ceramic rotary heat exchanger in which the pins 3 are arranged at the outer peripheral portion. The outer surface of the pin 3 is further machined to form the recess portion 5.

In the case that only half of the pin 3 is embedded in the matrix segment 1, the pin 3 is moved outward from the connecting portion between the pin 3 and the matrix segment 1, and a thickness of the connection portion thereof becomes larger and a crack is partly generated.

Figure 3:
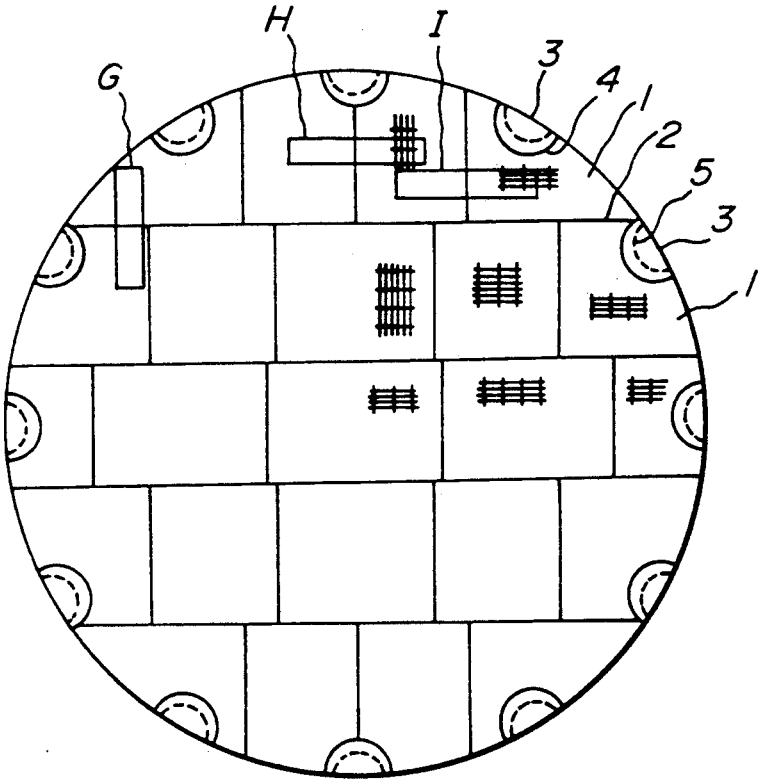
FIG. 3 PRIOR ART
FIG. 3 is a plan view illustrating an embodiment of a known ceramic rotary regenerator.

As compared with the ceramic rotary heat exchanger according to the invention, the known ceramic rotary heat exchanger in which a part of the pins 3 are positioned at the connecting portion 2 between the matrix segments 1 as shown in FIG. 3 is manufactured in the same manner (other than the pin arrangement).

With respect to the thus prepared heat exchanger according to the invention and the thus prepared known regenerator, a thickness of the connecting portion 2 between the matrix segments 1 is measured by using a profile projector having a magnification of 20×. As a result, the connecting portion 2 of the present invention nearest to the pin 3 is an average of 1.2 mm and the same portion of the known embodiment is an average of 1.5 mm. Therefore, the thickness of the connection portion of the known heat exchanger is 0.3 mm (25%) thicker than that of the present invention.

Then, thermal shock strengths of these regenerators are measured. The thermal shock test is performed in such a manner that the heat exchanger of the present invention and the heat exchanger of the comparative example are kept in an electric furnace maintained at a temperature of room temperature +700° C. for one hour. Afterwards, these regenerators are picked out from the furnace to observe whether or not a crack is generated. Then, when no cracks are generated, the temperature of the electric furnace is increased by 25° C. and the same thermal shock test is repeated at that temperature. As a result, the heat exchanger according to the invention generates a first crack at a temperature difference of 900° C., while the heat exchanger according to the comparative example generates a first crack at a temperature difference of 825° C. Therefore, it is confirmed that the heat exchanger according to the invention exhibits better thermal shock properties than that of the comparative example.

Moreover, samples having a dimension of 25.4×12.7×80 mm are cut out from D-I portions shown in FIGS. 1-3 and a four point flexural strength test is performed with respect to the samples in a condition such that an outer span is 60 mm, an inner span is 20 mm, and a load speed is 0.5 mm/min. As a result, both of the D-F portions of the present invention and the I portion of the comparative example show a flexural strength of 15 to 18 kg/mm$^2$, and a break point is at a position in the matrix segment 1 near the connecting portion 2. Contrary to this, the G-I portions of the comparative example show a flexural strength of 10 to 12 kg/mm$^2$, and a break point is at the connecting portion 2. In this result, since in both of the F portion of the present invention and I portion of the comparative example a distance from the connecting portion between the pin 3 and the matrix segment 1 to the connecting portion between respective matrix segments 1 is 10 mm, it is confirmed that the heat exchanger according to the invention exhibits a better flexural strength than that of the comparative example.

As mentioned above in detail, the ceramic rotary heat exchanger according to the invention can be made thicker in the thickness of the connection portion near the pin arranged in the outer peripheral portion thereof, and can be made to have higher mechanical strength, thermal shock strength, and heat exchanging efficiency as compared with the known regenerator. Moreover, according to the method of manufacturing the ceramic rotary heat exchanger mentioned above, the heat exchanger is manufactured in a reliable manner by eliminating a trouble generated near the pin during the sintering process.

Therefore, the ceramic rotary heat exchanger and the method of manufacturing the same according to the invention, which can prevent the drawbacks included in the known regenerator, contributes largely to a development of the industry.

What is claimed is:

1. A ceramic rotary heat exchanger comprising a plurality of matrix segments, made of ceramics and having a honeycomb structure, being connected with each other, by using an adhesion member, in a disk shape, and a pluarlity of pins arranged at an outer peripheral portion of said matrix segments, wherein said matrix segments are connected with each other in such a manner than none of said pins is positioned at connecting portions between respective matrix segments.

2. A ceramic rotary heat exchanger according to claim 1, wherein a distance from one of said connecting portions, between a pin and one of said matrix segments, to another of said connecting portions, between said respective matrix segments, is more than 10 mm.

3. A method of manufacturing a ceramic rotary regenerator, having a plurality of pins arranged at an outer peripheral portion thereof, comprising the steps of:

preparing a plurality of matrix segments made of ceramics and having a honeycomb structure;

connecting said matrix segments together with a foaming adhesion member;

embedding a plurality of pins at an outer peripheral portion of said connected matrix segments such that said pins are positioned more than 10 mm inside of edge portions of said connected matrix segments and none of said pins is positioned at connecting portions between respective connected matrix segments;

sintering said connected matrix segments and said pins; and machining said sintered connected matrix segments and said pins into a disk shape.

* * * * *